US006220922B1

(12) United States Patent
Lee et al.

(10) Patent No.: US 6,220,922 B1
(45) Date of Patent: Apr. 24, 2001

(54) MOLDED SOFT-SKINNED FIGURES WITH ARTICULATING MEMBERS

(75) Inventors: James S. W. Lee, Long Island, NY (US); Chiu-Keung Kwan, Kowloon (HK)

(73) Assignee: C. J. Associates, Ltd. (CN)

( * ) Notice: Subject to any disclaimer, the term of this patent is extended or adjusted under 35 U.S.C. 154(b) by 0 days.

(21) Appl. No.: 09/330,591

(22) Filed: Jun. 11, 1999

Related U.S. Application Data

(63) Continuation-in-part of application No. 08/950,705, filed on Oct. 15, 1997, now abandoned.

(51) Int. Cl.[7] ..... A63H 3/46
(52) U.S. Cl. ..... 446/383; 446/371; 446/385
(58) Field of Search ..... 446/369, 370, 446/371, 373, 375, 376, 381, 383, 385, 390

(56) References Cited

U.S. PATENT DOCUMENTS 807,895 * 12/1905 Allert ..... 446/383
1,709,432 * 4/1929 Hill ..... 446/381
2,606,398 * 8/1952 Miller .
3,277,601 * 10/1966 Ryan ..... 446/378
3,350,812 * 11/1967 Lindsay et al. ..... 446/383
3,432,581 * 3/1969 Rosen .
3,699,714 * 10/1972 Johnson et al. .
3,716,942 * 2/1973 Garcia et al. ..... 446/383 X
3,852,389 * 12/1974 Adler et al. .
3,881,276 * 5/1975 Kosicki et al. ..... 446/383
4,055,020 * 10/1977 Kosicki et al. .
4,169,336 * 10/1979 Kuhn .
4,274,224 * 6/1981 Pugh et al. ..... 446/383 X
4,767,505 * 8/1988 Satoh et al. .
4,824,410 * 4/1989 Sommer ..... 446/371
4,908,001 * 3/1990 Kopian .
4,952,190 * 8/1990 Tarnoff et al. .
5,162,013 * 11/1992 von Mohr .
5,939,480 * 8/1999 Lee et al. ..... 524/296

* cited by examiner

*Primary Examiner*—D. Neal Muir
(74) *Attorney, Agent, or Firm*—Laff, Whitesel & Saret, Ltd.; Martin L. Stern; Jeffrey H. Canfield

(57) ABSTRACT

An inanimate figure having soft, resiliently deformable skin defining a body and limbs, at least one of the limbs housing an articulating limb structure comprising at least two substantially rigid limb frame members joined by at least one articulating joint disposed therebetween.

24 Claims, 13 Drawing Sheets

MOLDED SOFT-SKINNED FIGURES WITH ARTICULATING MEMBERS

CROSS-REFERENCE TO RELATED APPLICATIONS

This is a continuation-in-part of application Ser. No. 08/950,705 filed on Oct. 15, 1997, now abandoned.

FIELD OF THE INVENTION

The present invention generally relates to toy figures or dolls and more particularly to toy figures having deformable skin and one or more articulating limbs comprising rigid structural members which articulate with respect to each other.

BACKGROUND OF THE INVENTION

A variety of dolls and action figures are known which are made by molding a soft polyvinyl chloride resin or other soft plastic material. It is considered desirable to provide such toy figures with an exterior texture that simulates the feel of skin. It is also considered desirable to provide flexible limbs to permit a child to manipulate the toy figure creatively.

U.S. Pat. No. 3,699,714 discloses a doll having a foam body and limbs with a flexible wire housed within the limbs to make them bendable into various positions.

U.S. Pat. No. 2,606,398 describes a stuffed doll formed by coating a form with latex coagulant, dipping the coated form in a vulcanizable rubbery material, drying the material and vulcanizing the doll. The doll is then removed from the form and filled with textile fibers, rags or similar yielding materials.

U.S. Pat. No. 4,055,020 describes a rotationally molded doll torso which is filled with pressurized air. The torso is provided with joints for rotatingly attaching the head and limbs.

U.S. Pat. No. 4,169,336 describes a doll having stretchable arms and legs which can be drawn into various configurations. The doll has an external skin of elastic film and is filled with a viscous liquid such as corn syrup.

The prior art toy figures and dolls having soft resilient skin and flexible limbs do not provide realistic ranges of articulation for the limbs. It would be desirable to provide a toy figure with a skin layer that is soft and resiliently deformable and limbs with rigid limb member that act as "bones" that are capable of articulating relative to one another in a realistic manner.

SUMMARY OF THE INVENTION

The present invention provides a toy figure or doll with articulating limbs comprising rigid limb members connected by articulating joints. The toy figures of the present invention preferably have a hollow body made of a resiliently deformable, soft skin layer and are preferably stuffed with a soft fill material to further simulate a "live" feel.

In a preferred embodiment, the skin of the body and limbs of a toy figure of the invention are cast separately and assembled. The limbs are preferably joined to the body by e.g., connector joints, although it is also contemplated that the articulating limbs may be completely enclosed within the limbs, with the limbs and body of the toy figure being joined by adhesive or other means. Alternatively, the toy figure may be molded as a single piece and the articulating limbs inserted through openings at the extremities of the limbs which are then patched, for example by an injection molded piece, optionally with the distal ends of the articulating limb structures being glued to the inside surface of the injection molded patches.

The body and limbs of the toy figure or doll are cast by conventional rotational molding or slush molding as is well known in the art. The cavities of the body and limbs are preferably stuffed with polyester fiber, gel or other soft, deformable material.

In particularly preferred embodiments, the toy figure may be sized up to 2–3 feet or more in length or more with limbs up to 18 inches or more in length. Toy figures of this size are sometimes referred to as "my size" figures, referring to their size relative to a child.

DETAILED DESCRIPTION OF THE INVENTION

The toy figures of the present invention preferably comprise separately molded torsos and limbs which are stuffed with a fill material, fitted with one or more articulating limb structures and connected during assembly. The terms "limbs" as used herein is meant to encompass arms, legs, heads, tails or other components that may be molded separately from the torso and connected to the torso during assembly.

Figure 1:
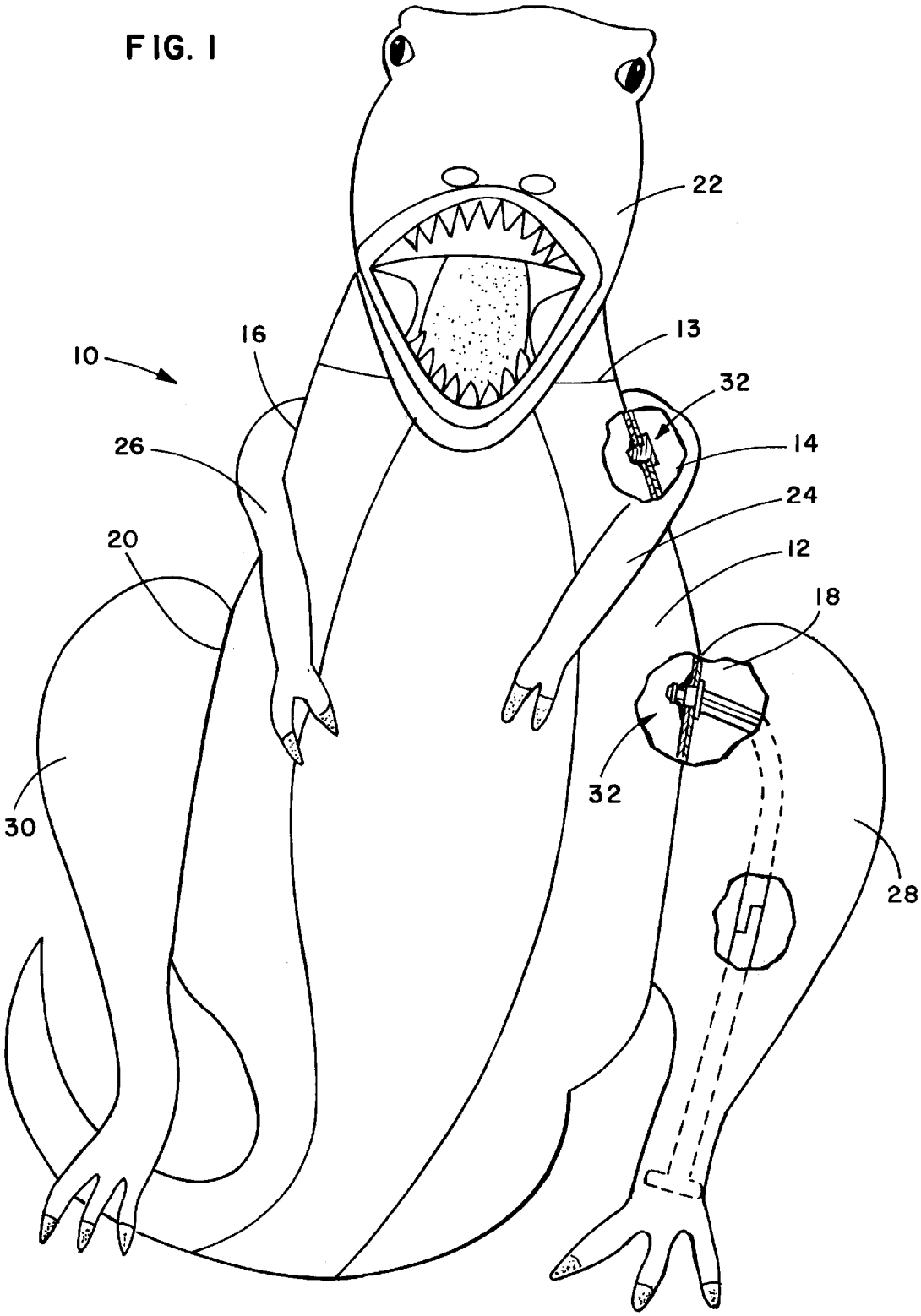
FIG. 1 is a toy figure of the present invention with certain sections broken away to show the underlying structural components of the articulating limbs and their attachment to the body.
Figure 10:
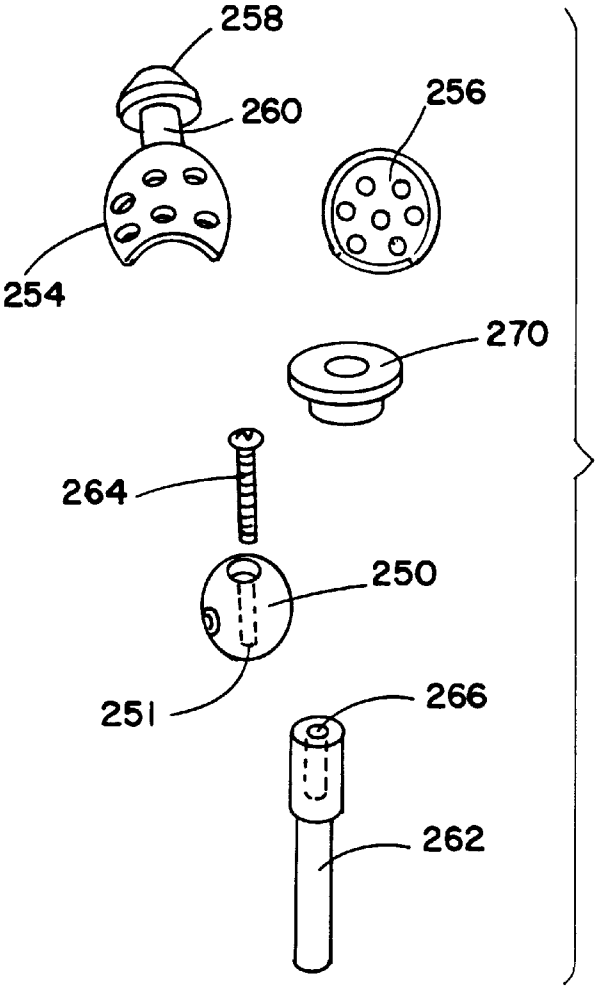
FIG. 10 shows an exploded view of the structural components of the upper portion of an articulating leg having a connector joint at the hip which comprises an articulable ball joint.

Referring to FIG. 1, a toy FIG. 10 includes a torso 12 truncated at the head/neck attachment area 13, left shoulder attachment area 14, right shoulder attachment area 16, left hip attachment area 18 and right hip attachment area 20. The toy figure includes a head and neck 22, left arm 24, right arm 26, left leg 28 and right leg 30, each having corresponding attachment areas. These limbs are attached to the torso at the respective attachment areas by mushroom joints 32, as more fully described below, which permit rotation of the limb relative to the body.

Figure 7:
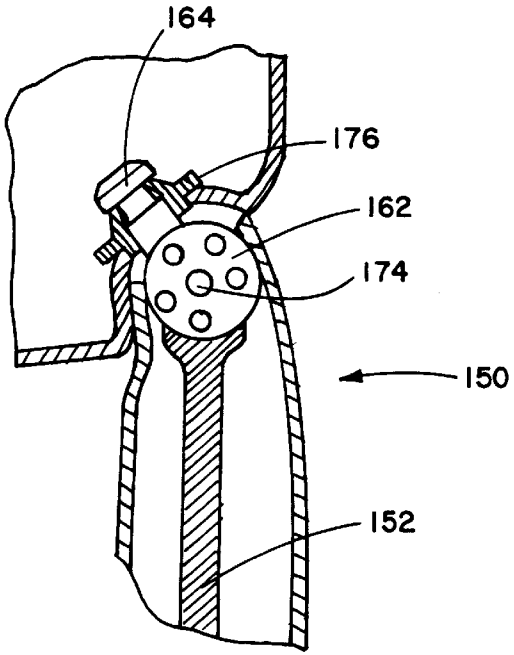
FIG. 7 is a view in partial cross section of the articulating leg of FIG. 6 showing attachment of the upper portion of the leg to the body at the hip using a pivoting connector joint.

In a presently preferred embodiment of the invention, the limb attachment areas of the torso and the corresponding attachment areas of the limbs, are sized and shaped to mate complementarily with each other and facilitate articulation at the point of connection, if desired. The two respective attachment areas may be generally planar (e.g., 14, 16) where the desired articulating movement is only rotation, although preferably, where the connection used to join the limb to the torso comprises a pivot joint, ball joint or the like, the torso is provided with a recessed or cup-shaped limb attachment area (e.g., as depicted in FIG. 7) to receive the corresponding limb.

To facilitate articulation of, for example, the knees and elbows of a toy figure, the external skin of the limbs optionally may be molded to provide accordion-like pleats (not shown) which fold to accommodate excess skin as the structural members articulate between their fully extended and contracted positions. The pleats may be provided on the backside or frontside of the limb or both. The pleats may be provided on limbs which have or do not have articulating structural members inside. The pleats also provide a convenient way to store a toy figure of the present invention by folding the limbs to lie adjacent to the body so as to be relatively compact during storage. This feature is also advantageous for shipping.

The skin of the torso and limbs may be formed from any suitable resiliently deformable vinyl resin material including pliable polyvinyl chloride compositions known in the art. The skin is preferably molded by rotational casting or slush molding methods. The applicants' presently preferred polymer formulations comprise about 35%–45% polyvinyl chloride; about 50%–60% di($C_7$–$C_{12}$alkyl)phthalate, wherein the alkyl moieties are linear or branched and are the same or different; about 1%–3% epoxidized soybean oil (as a high-temperature resistance agent); about 1%–3% of a liquid calcium and zinc organic complex stabilizer (as a heater stabilizer) and up to 1% pigment. The polymer compositions may optionally contain about 0.5%–1% plasticizer such as Kodaflex TXIB (trimethyl pentamediol diisobutyrate), available from Eastman Chemical Co., (CAS No. 68-46-50-0), as a hardener to adjust the rigidness of the skin as needed. Among the dialkylphthalate compounds which may be used are diisoheptylphthalate, diisooctylphthalate, diisononylphthalate and the like. Diisononylphftalate is most preferred. Diisononylphthalate is commercially available under the tradename "Jayflex" from Exxon Chemical Company. Such polymer formulations enable rotational casting or slush molding of molded torso and limb pieces that may be up to about 24 inches to 36 inches in length or more and have a finely textured and resiliently deformable skin of uniform thickness throughout. Molded pieces of such a large size and with uniform skin thickness are not attainable with conventional polymer formulations. The presently preferred polymer formulation for use in forming the skin of the toy figures of the present invention comprises about 40% polyvinyl chloride; about 55% diisononylphthalate; about 2% epoxidized soybean oil; about 2% calcium/zinc (as a heat stabilizer); about 1% pigment; and optionally about 0.5%–1% plasticizer.

The skin of the torso and limbs may be molded by adding a predetermined amount of skin-forming polymer into the cavity of the mold and rotating the mold to ensure uniform coverage of the polymer on the inner surface of the mold. As is known, conventional rotational casting involves rotating the mold around a first axis while it is simultaneously being moved orbitally around a second axis which is generally at a right angle to the first. In rotational casting or slush molding, the mold is heated to cause the skin layer to form on the inner surface of the mold. Alternatively, the mold may be entirely filled with the skin-forming polymer and heated to cause the skin layer to form on the inner surface of the mold, with the remaining liquid polymer being decanted after the molded skin having the desired thickness is formed.

In a presently preferred method for molding torso and limb components, the resin composition is made by mixing 55 parts by weight diisononylphthalate, 40 parts by weight polyvinyl chloride powder and optionally 0.5 to 1.0 part by weight Kodaflex™ TX1B plasticizer (CAS No. 68-46-50-0) with constant stirring. After these ingredients are thoroughly mixed, 2 parts by weight epoxidized soybean oil, 2 parts by weight Ca/Zn heat stabilizer (Brainstab CZ-101, Brain Resources Enterprises Company Limited, Kowloon, Hong Kong) and 1 part by weight pigment is added with constant mixing. The ingredients are blended for three hours, followed by degassing in a vacuum chamber for between 10 and 30 minutes to remove air bubbles from the blending process.

The present invention may be practiced, for example, in constructing a torso about 10 inches in length and about 15 inches in circumference at its widest point by blending and degassing a resin composition as described and then injecting it into a pumping device connected as is known in the art to a selected slush mold. The slush mold is fully filled and the filled mold is then dipped into a 200° C. liquid wax pool for 1 ½ minutes to form a raw skin. The mold is then removed and the excess resin composition from the first heating step is poured off, leaving the raw skin formed on the inside walls of the slush mold. The raw skin from the first heating step is then "matured" by re-dipping the slush-mold for a second treatment at 200° C. for an additional 2 minutes. The mold is then transferred to a running cold water bath for about 4½–5 minutes to separate the matured skin from the inner walls of the slush mold. The matured skin is then removed through the opening of the slush mold, carefully avoiding damage to the skin.

It will be understood that dimensions, quantities of materials, and processing times and temperatures are only illustrative since conventional rotational molding or slush molding concepts can be utilized in combination with the presently preferred polyvinyl chloride/ldiisononylphthalate composition or a variety of conventional polymer formulations for forming articles of various sizes and shapes, with the quantities of materials and processing conditions being readily determined by those skilled in the art for the particular article being formed.

As mentioned above, the torso and limbs of a toy figure of the present invention may desirably be filled with a soft resilient stuffing material. The stuffing material may be made of any resilient material that imparts, in combination with the resiliently deformable skin, a desirable tactile quality to the toy figure. A presently preferred stuffing material is polyester fiber which is made by heating polyester pellets and "pulling" them into fibrous strands as is known in the art. Alternatively, the stuffing material may be a gel or a suitable natural or synthetic fiber or cloth.

The toy figures of the present invention have one or more articulating rigid structures within their limbs. The articulating limbs of the present invention are generally comprised of two or more substantially rigid structural members connected end-to-end or serially with an articulating joint between adjacent structural members. The structural members of the limb may be dimensioned to resemble the bones of the limb.

The articulating joint connecting two structural members may be any suitable type of joint that permits pivoting, rotating and/or swiveling motion between adjacent structural members of the limb. Examples of such articulating joints include pivot joints, clevis joints, ball joints and the like.

The structural members of the limbs and the joints are preferably cast of a suitably rigid material. It is presently preferred to cast the structural members of the limbs and joints by injection molding employing polycarbonate, polyethylene, polypropylene, polystyrene, polyvinyl chloride, acrylonitrile-butadine-styrene or the like. The various joint members may be affixed or adhered to the structural members of the limb or, preferably, may be incorporated into (e.g., cast integrally with) the end of a limb structure as described herein.

The skin of the limbs, whether containing an articulating limb structure or not, may be joined to the torso by connector joints. One type of connector joint is a mushroom joint. The first member of such a connector joint comprises a flange and a rounded or mushroom-shaped head spaced apart from each other by a spacer piece; and the second member of the connector joint comprises a substantially rigid, resilient bushing that is elastically deformable to receive and retain the rounded head of the joint. One joint member is seated within the torso at the limb attachment area and the other joint member is seated within the limb at the corresponding attachment area. The spacer piece of the connector joint member is sized so that the attachment areas of the torso and limb may be brought together in between the flange and bushing surfaces, preferably while allowing rotation of the limb relative to the torso. See, for example, FIGS. 4 and 5. Where the limb contains an articulating limb structure, connector joints used to connect the proximal end of a limb to the torso may be a mushroom type joint that optionally comprises a pivot joint or ball joint disposed between the limb structure and torso, as described below. See, for example, FIG. 7.

Figure 3:
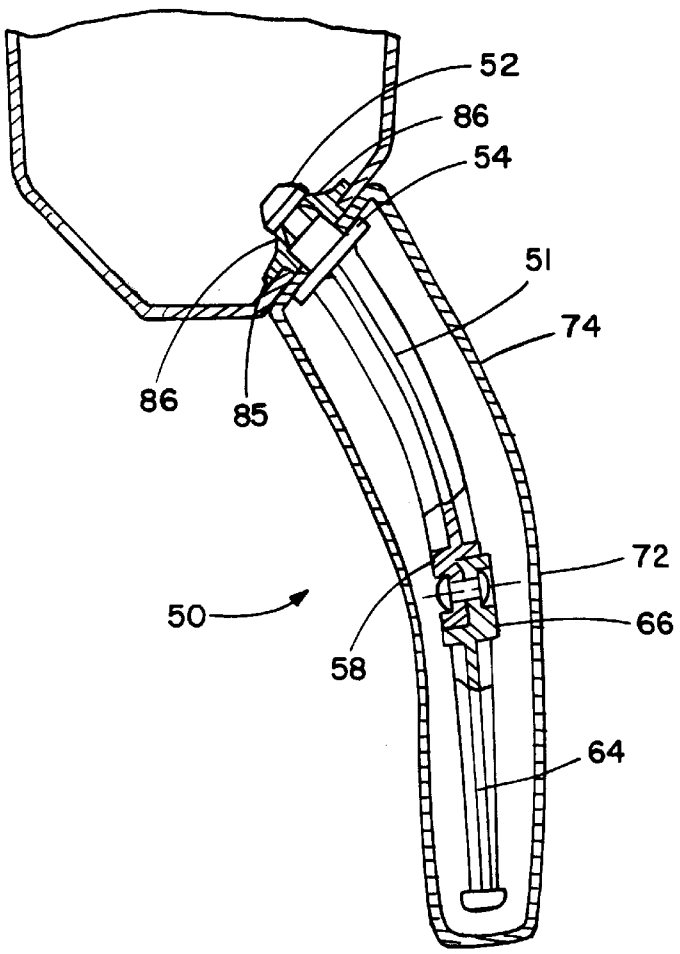
FIG. 3 shows, in partial cross section, an articulating leg having a pivot joint at the knee and connected to the body at the hip by a nonarticulating connector joint.
Figure 2:
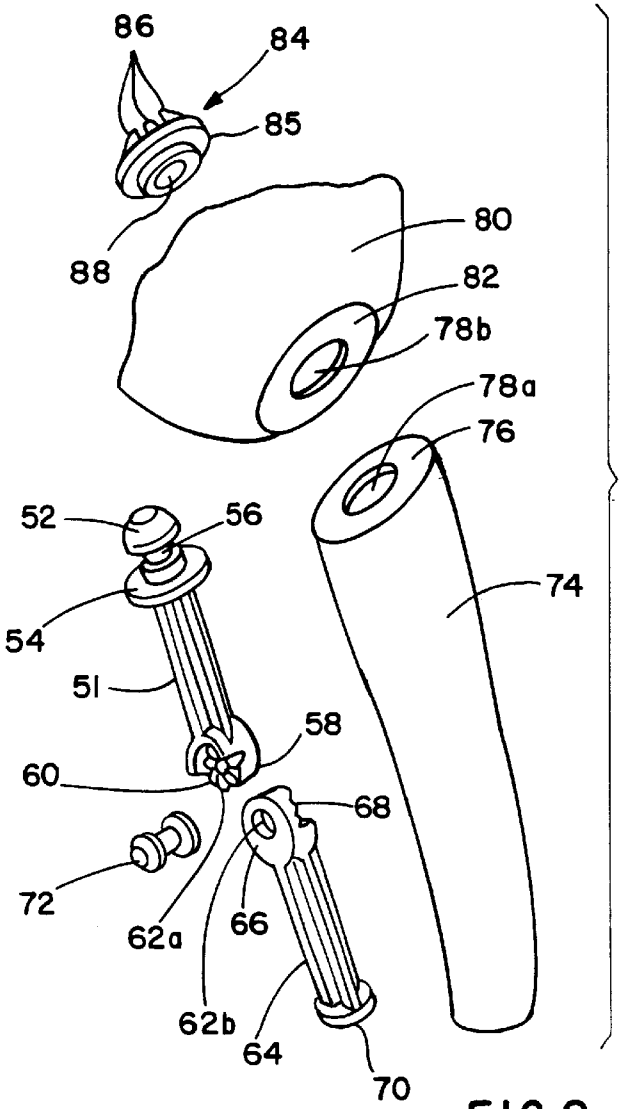
FIG. 2 is an exploded view showing the structural components of an articulating leg having a pivot joint and portions of the external skin of the body and leg.

FIGS. 2 and 3 show a leg 50 comprising an elongate upper leg frame 51 adapted at the hip end with a first member of a connector joint comprising a rounded head 52 spaced apart from flange 54 by a spacer piece 56. The upper leg frame is adapted at the "knee" to terminate in a routed and radiused end 58 having a serrated mating face 60 with a bore 62*a* running through the center thereof. Lower leg frame comprises an elongate shaft 64 that terminates at its upper (knee) end in a routed radiused end 66 with a serrated mating face 68 and a round bore 62*b* through the center thereof, and terminates at its lower end in a substantially flat surface foot 70. The lower leg frame is complementarily shaped at its upper end 66 to mate pivotally with the lower end 58 of the upper leg frame. The leg 50 articulates about a pivot point formed when ends 58 and 66 are aligned and connected with pin 72. The outer portions of bores 62*a* and 62*b* may be slightly enlarged or countersunk so that the pin 72 will fit flush with or below the surface of the leg frames 51, 64 as shown in FIG. 3. The serrated faces 60, 68 allow the leg frames 51, 64 to pivot incrementally with respect to each other from one position to the next as the peaks and troughs of the serrated faces engage each other.

The articulating leg structure is sized to fit into skin 74, which forms a hollow leg having a leg attachment area 76 at the upper portion thereof with an opening 78*a* into the interior of the leg. The torso 80 has a corresponding leg attachment area 82 and opening 78*b* into the interior of the body for receiving head 52. The articulating leg structure is inserted into the interior of the leg 74 through opening 78*a* so that the flange 54 is retained by the interior skin surface of area 76 and head 52 and spacer 56 extend through opening 78*a*. Skin 74 containing the articulating leg structure is attached to the torso 80 (optionally after stuffing the body and limbs with suitable filling material) by passing head 52 through openings 78*a* and 78*b* and pressing it onto bushing 84 (preferably glued to the interior of the body skin) in alignment with opening 78*b* thereby bringing skin surfaces 76 and 82 into contact between flange 54 and bushing 84, as depicted in FIG. 3. Bushing 84 comprises a flanged collar 85 with a plurality of fingerlike projections 86 rising and extending inwardly from the flange to receive and retain head 52 when it is pressed through the opening 88 of bushing 84. Leg 50 pivots at the knee and is joined to the body by a mushroom connector joint at provide rotation at the hip.

Figure 5:
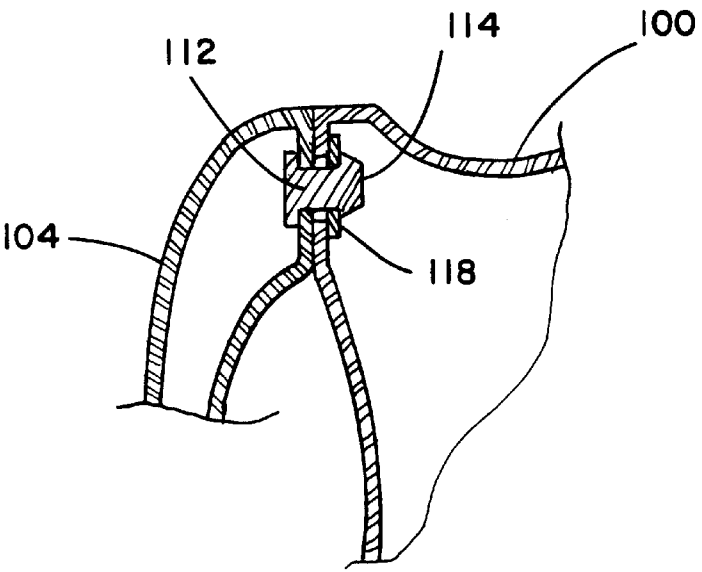
FIG. 5 is a cross sectional view of the assembled arm and body portion depicted in FIG. 4.
Figure 4:
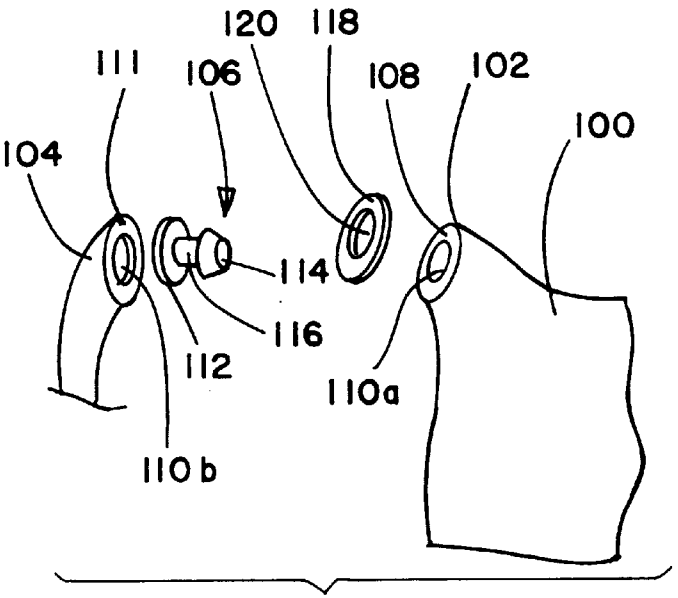
FIG. 4 shows an exploded view of portions of the external skin of the body and arm and the structural components for attaching the arm and body using a nonarticulating connector joint.

FIGS. 4 and 5 show torso 100 truncated at shoulder 102 and attached to arm 104 by connector joint 106 which comprises a flange 112 and a rounded head portion 114 spaced apart by spacer piece 116. The torso 100 is truncated at shoulder attachment area 108 having an opening 11O*a*. The arm 104 has a complementary shoulder attachment area 111 having an opening 110*b* into the interior of the arm. The flange portion 112 of shoulder joint 106 is inserted into arm 104 through opening 110*b* (by slight elastic deformation at attachment area 111) and seated against the interior surface of area 111 with the head 114 and spacer 116 protruding through the opening 11O*b*. Bushing 118 is inserted into the interior of the torso (and preferably glued in alignment with the opening 11O*a*). Head 114 of connector joint 106 is then pressed through the opening 120 of bushing 118 rotatingly to connect the arm 104 to the body 100. Arm 104 is capable of 360° rotation relative to the torso.

Figure 6:
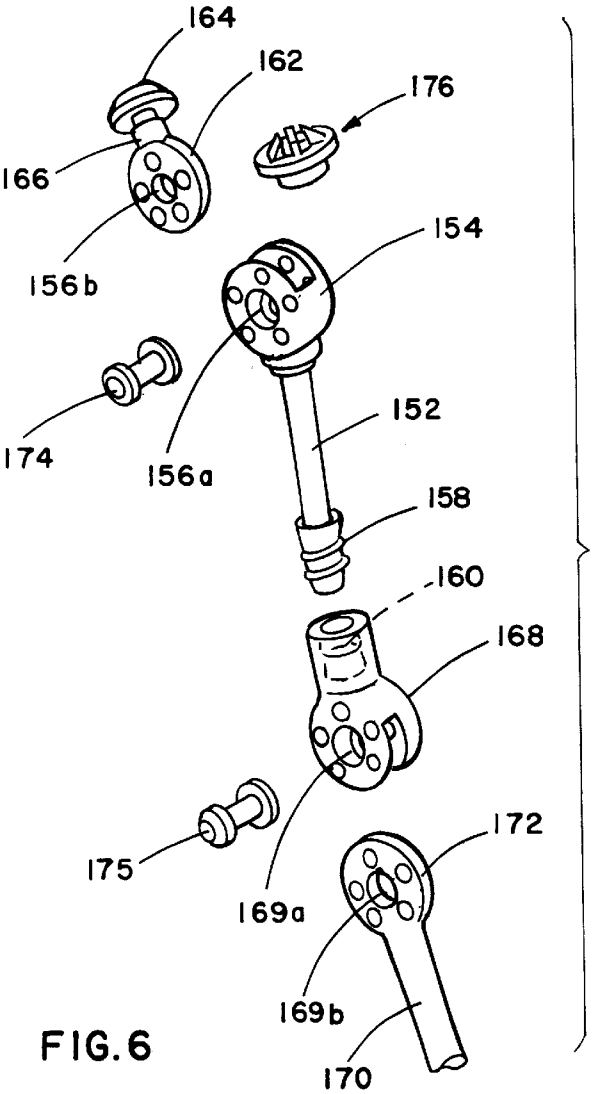
FIG. 6 is an exploded view of the structural components of an articulating leg having a pivot joint at the knee and which is connected to the body using an articulating connector joint that provides a pivot joint at the hip.

With reference to FIGS. 6 and 7, another embodiment of the present invention is shown wherein the articulating leg is connected to the torso with a connector joint comprising a clevis joint. As used herein a "clevis" refers to a type of pivot joint that comprises a slotted or "U-shaped" piece and a flat piece which fits within the "U". Each of the two pieces has a bore running therethrough to accept a pin for pivotally connecting them.

Leg 150 comprises an upper leg frame 152 is adapted at its hip end with a slotted clevis member 154 having a bore 156 running therethrough and adapted at its knee end with a slotted clevis member 168 having a bore 169 running therethrough. The slotted clevis 154 and upper leg frame 152 are shown assembled (i.e., snap-fitted) as a single piece, while slotted clevis 168 is shown prior to being connected to leg frame 152 to reveal the configuration of the snap-fit connection. Thus, the lower end of leg shaft 152 and slotted clevis 168 are shown with complementary male and female portions (158, 160) that may be joined together as a snap-fit connection as is well known in the art. The hip joint of the upper leg further comprises a modified flat clevis piece 162 adapted to have a rounded head 164 spaced apart from the flat clevis member 162 by a spacer 166 to provide a connector joint member.

The lower leg frame 170 comprises an elongated shaft adapted at its knee with a flat clevis member 172. When the clevis members 162 and 154 are brought into alignment (at bores 156*a*, 156*b*) and connected with pin 174, and clevis members 172 and 168 are brought into alignment (at bores 169*a*, 169*b*) and connected with pin 175, a leg structure having a pivoting hip joint and a pivoting knee joint is provided. The articulating leg structure is connected to the body of the toy figure by pressing rounded head 168 onto bushing 176, essentially as described above with reference to FIGS. 2 and 3.

Figure 9:
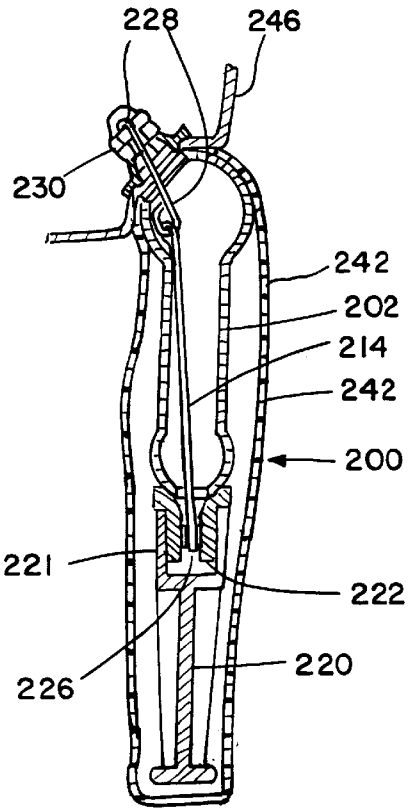
FIG. 9 is a cross sectional view of the assembled articulating leg of FIG. 8 showing the connection of the structural members of the leg limb to each other and to the body.
Figure 8:
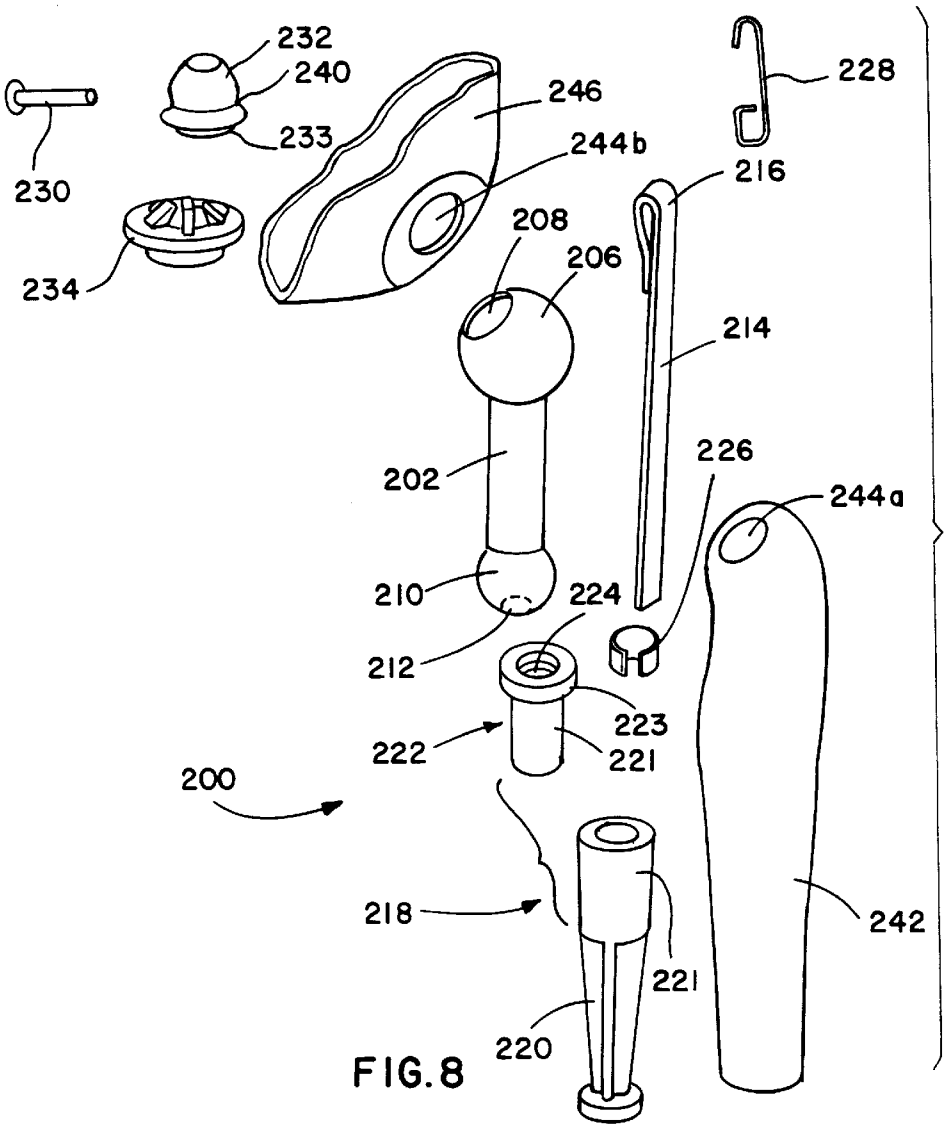
FIG. 8 is an exploded view of the structural components and external skin layer of an embodiment of the present invention wherein an articulating leg comprises substantially hollow structural members having complementary ball and cup ends at the knee and connected by elastic means to provide a swiveling knee joint.

FIGS. 8 and 9 depict an embodiment of the present invention in which the articulating limb is hollow and is connected by an elastomeric band running therethrough. In this embodiment a swiveling knee joint is provided by maintaining the rounded head at the lower end of the upper leg frame seated in a cup-shaped leg bushing at the upper end of the lower leg frame to form a type of ball joint.

The articulating leg 200 comprises a hollow, generally cylindrical upper leg frame 202 adapted at its upper end with a rounded head 206 having an opening 208 therein, and adapted at its lower end with rounded head 210 having an opening 212 therein. The lower leg 218 comprises a lower leg frame 220 with a cylindrical upper portion 221 sized to retain (e.g., by adhesive or friction fit) lower leg bushing 222. Leg bushing 222 comprises a flange 223 and has a tapered bore 224 running longitudinally through the bushing, the bore having a relatively larger diameter at the (upper) flange end to form a "socket" upon which rounded head 210 is seated for articulation. The upper and lower leg frames are connected to each other and to the body by an elastomeric band 214 which is provided at one end with an eyelet 216 for attachment to hook 228, which hook is configured with two curled ends, one of which receives eyelet 216 of the elastic band and the other of which anchors the band to a rivet 230 inside connector joint 232 as shown in FIG. 9. The rivet 230 passes transversely through bore 240 of connectorjoint 232.

The end of bore 224 opposite the flanged end is sized to allow the free end of elastomeric band 214 to pass therethrough, but restrict passage of retainer clip 226 when it is crimped onto the free end of band 214. The upper and lower leg frames are connected during assembly by threading the elastomeric band through the bore of the lower leg bushing and crimping clip 226 to the lower end of band 224 (and then connecting bushing 222 and lower leg frame 220) and threading the upper end of band 224 through openings 212 and 208 of the upper leg frame and anchoring eyelet 216 to rivet 230 via hook 228 such that the elastic force exerted by band 214 causes rounded head 210 to be seated in the cup-shaped end of lower leg bushing 222 to form a ball joint connection and causes rounded head 206 to be seated rotatingly on flange 233 of joint 232. The assembled leg structure is inserted into skin 242 with the connector joint member 232 protruding from opening 244*a*, and articulating leg 200 is connected to torso 246 by pressing the head of connector joint 232 onto bushing 234 retained within the torso 246 in alignment with opening 244*b*. The attached leg 200 is capable of rotating at the hip and swiveling at the knee.

Figure 11:
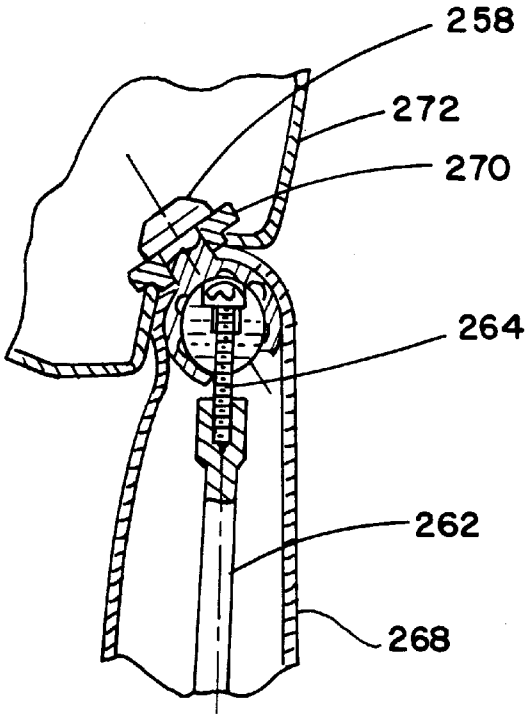
FIG. 11 shows a cross sectional view of an upper leg and connector ball joint assembled and attached to the body.

FIGS. 10 and 11 depict an embodiment of the present invention having a connector joint comprising a socket member of a ball joint and the "hip" end of the upper leg frames comprises a ball member of the ball joint. In this embodiment, the connector joint/socket combination is provided as two half-sockets 254, 256 divided bilaterally along an axis of the socket. Half-socket 254 further comprises a rounded head 258 spaced apart from half-socket 254 by spacer piece 260 to provide a member of a connector joint.

Ball 250 is attached to upper leg member 262 by screw 264 which extends through bore 251 and into threaded bore 266 of upper leg frame 262. Ball 250 is articulably retained in the socket formed when the two socket members 254, 256 are joined edgewise such as by adhesive or snap-fitting. In this embodiment the structural components of the knee joint and lower leg may be similar to a previously described embodiment (e.g., pivot joint, clevis joint, etc.).

The assembled leg is installed in the skin 268 and is attached to the torso 270 by pressing head 258 of the connector joint onto bushing 270 (aligned with the limb attachment area of the torso 272) as described above with reference to FIGS. 2 and 3. The upper leg is thus capable of rotating and pivoting in any direction relative to the body.

Figure 13:
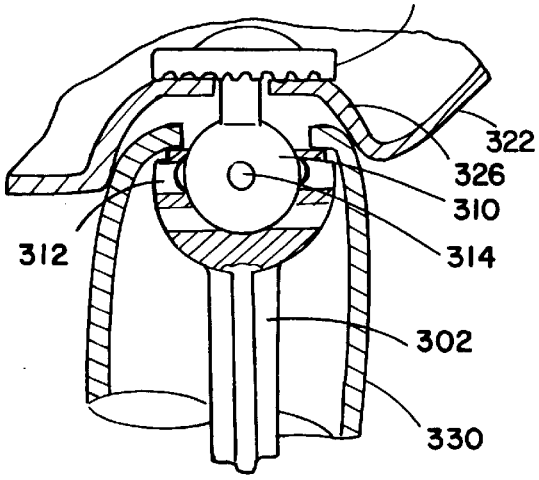
FIG. 13 shows the articulating connector joint (hip) and upper leg structure, leg depicted in FIG. 12, assembled and attached to the body.
Figure 12:
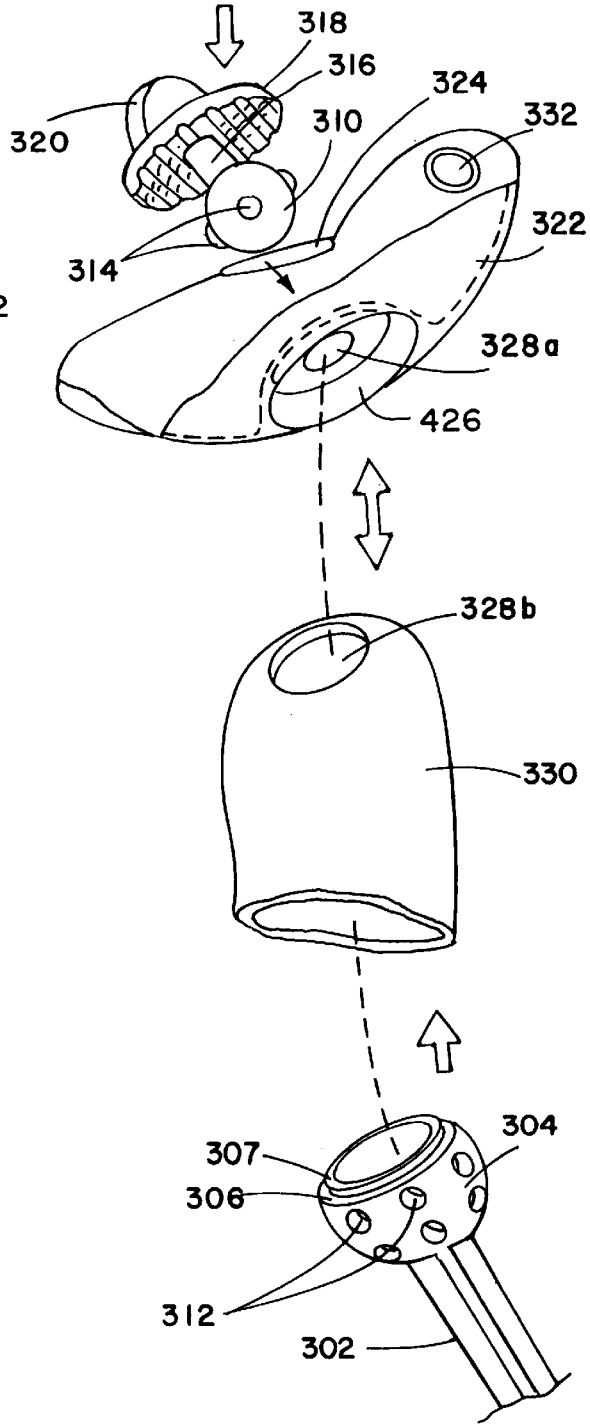
FIG. 12 depicts an exploded view of the structural components of the upper leg and connector joint comprising a ball joint wherein the upper leg structure is adapted to form the socket of the ball joint.
Figure 14:
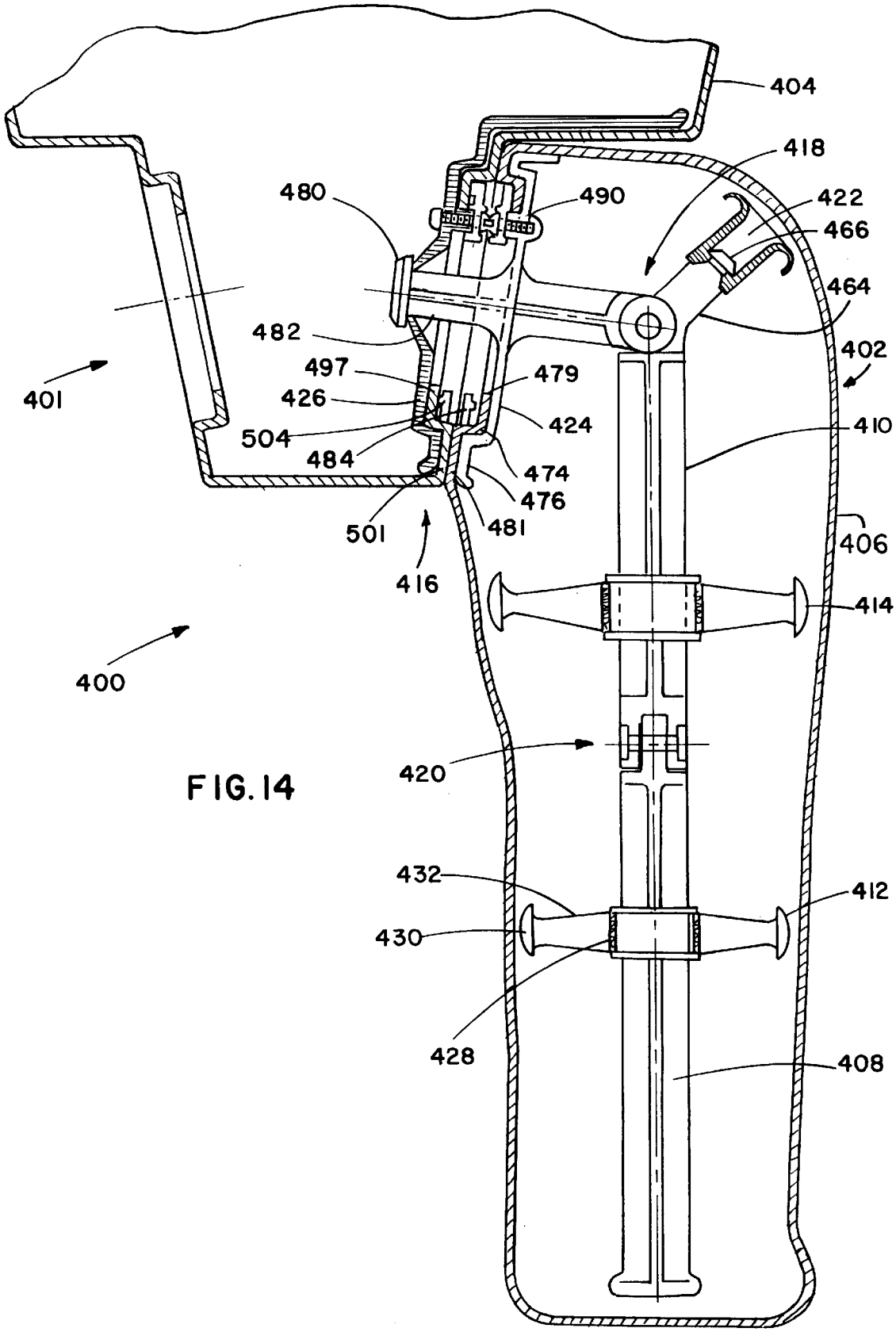
FIG. 14 is a cross sectional view of the leg and a portion of the body of a toy figure according to an alternate embodiment of a soft-skinned figure with internal articulating members.

With reference to FIGS. 12 and 13, a particularly preferred embodiment of a ball joint is shown wherein the ball member of the ball joint carries a flange member to seat it within the torso (without the use of a mushroom joint).

In this embodiment, the ball joint members are formed from acrylonitrile-butadine-styrene and fit together in a snap fit arrangement. Upper leg frame 302 is adapted at its upper end with a socket 304 that has a generally hemispherical shape. Socket 304 terminates at it upper surface in an anular flange 306 having a short collar 307. The collar 307 has a diameter that is smaller than the diameter of the socket, yet large enough to allow the ball member 310 to be snap-fit into articulating contact with socket 304. Socket 304 is provided with a plurality of symmetrically spaced apertures 312 which engage the knobs 314 complementarily disposed on ball 310 to reversibly retain the ball joint in one of several predetermined positions when the knobs 314 and apertures 312 are aligned for engagement. It will be appreciated that the lower leg frame (not shown) may be articulably connected to the upper leg frame by a ball joint, pivot joint, clevis joint or the like as described herein with reference to other embodiments of an articulating limb.

The ball member of the ball joint carries a flange 318 having a diameter larger than that of ball 312. The flange 318 is spaced apart from ball 312 by spacer piece 316 which extends axially from the ball 310. Flange 318 is sized to firmly anchor the ball member within the torso with the ball 310 and spacer piece 316 extending through the opening 328*a* of the limb attachment area 326 of the torso 322 and into the opening 328*b* of skin 330.

The flange 318 is adapted with a tab 320 on the side opposite the spacer piece 316 which can be grasped, for example, by hand to facilitate installation of the ball member within the torso 322. To assemble the ball joint, the ball member and flange are inserted through the head attachment opening 324 of torso 322 and the flange 316 is seated on (and preferably cemented to) the inside surface of the limb attachment area 326, with the ball member 312 and spacer piece 316 extending through opening 328*a* therein. The articulating leg structure comprising leg frame 302 is inserted into the skin 330 and positioned so that the flange 306 is in contact with (and preferably cemented to) the inside surface of skin 330 in alignment with opening 328*b* with collar 307 extending through opening 328*b*. Snap-fitting ball 312 into socket 308 results in attachment of the articulating limb to torso 322 and provides articulation of the limb relative to the torso. Torso 322 is depicted with limb attachment area 332 for attachment of an arm (not shown). Torso 322 is completed by joining the remaining leg, arms and head to the torso (optionally, after stuffing the torso and limbs with a suitable fill material) in accordance with the description herein.

Turning to FIGS. 14–19, another embodiment of an articulating limb for a toy figure having a life-like pliable outer skin is shown at 400. The limb 400 is joined to a body 401 of the toy figure. The limb shown in the figures and described below is generally related to a leg, however, the structural elements of the leg may be easily modified to form an arm or other appendage without deviating from the novel aspects of the present invention. The body includes a pliable skin 404, and the leg skin 406. Both the body skin and the leg skin may be formed of any suitable resiliently deformable vinyl resin material and molded as described above. The skin may be further stuffed with a polyester fill to provide a more pliable life-like feel to the skin.

The internal structural components of the articulating limb include a lower leg member 408 and an upper leg member 410. The lower leg member 408 is pivotally joined to the upper leg member 410 to form a knee joint 420. The upper leg member 410 is similarly pivotally joined to an annular disk 424 to form a lateral hip joint 418 which allows the limb 400 to be pivoted away from the body 401. As will be described in more detail below, the annular disc 424 may be joined to a receiving disk 426 mounted within the body 401. Together, disk 424 and receiving disc 426 form a rotating hip joint 416. Radial spacers 412 and 414 are placed around the lower and upper leg members respectively to support the outer skin. A linear spacer 422 extends from the lateral hip joint to provide outward support of the skin near the upper portion of the limb.

Radial spacers 412, 414 are substantially identical, comprising a central hub 428 and an outer annular ring 430 supported from the hub by a plurality of spokes 432. The central hub includes a bore 436 surrounded by a plurality of narrow radial slots 433. Each of the lower and upper leg members 408, 410 include a spacer support area 438 defined by vertically spaced rings 440 of diameter nominally larger than that of the bore 434 through the central hub of the radial spacers 412, 414. The spacers are mounted on each of the upper and lower leg members by sliding the members through the bore 434 and forcing the hub over a first support ring so that a support ring engages and supports each side of the hub. Ribs 435 formed on the leg members align with the slots 433 to hold the spacers in place.

Figure 15:
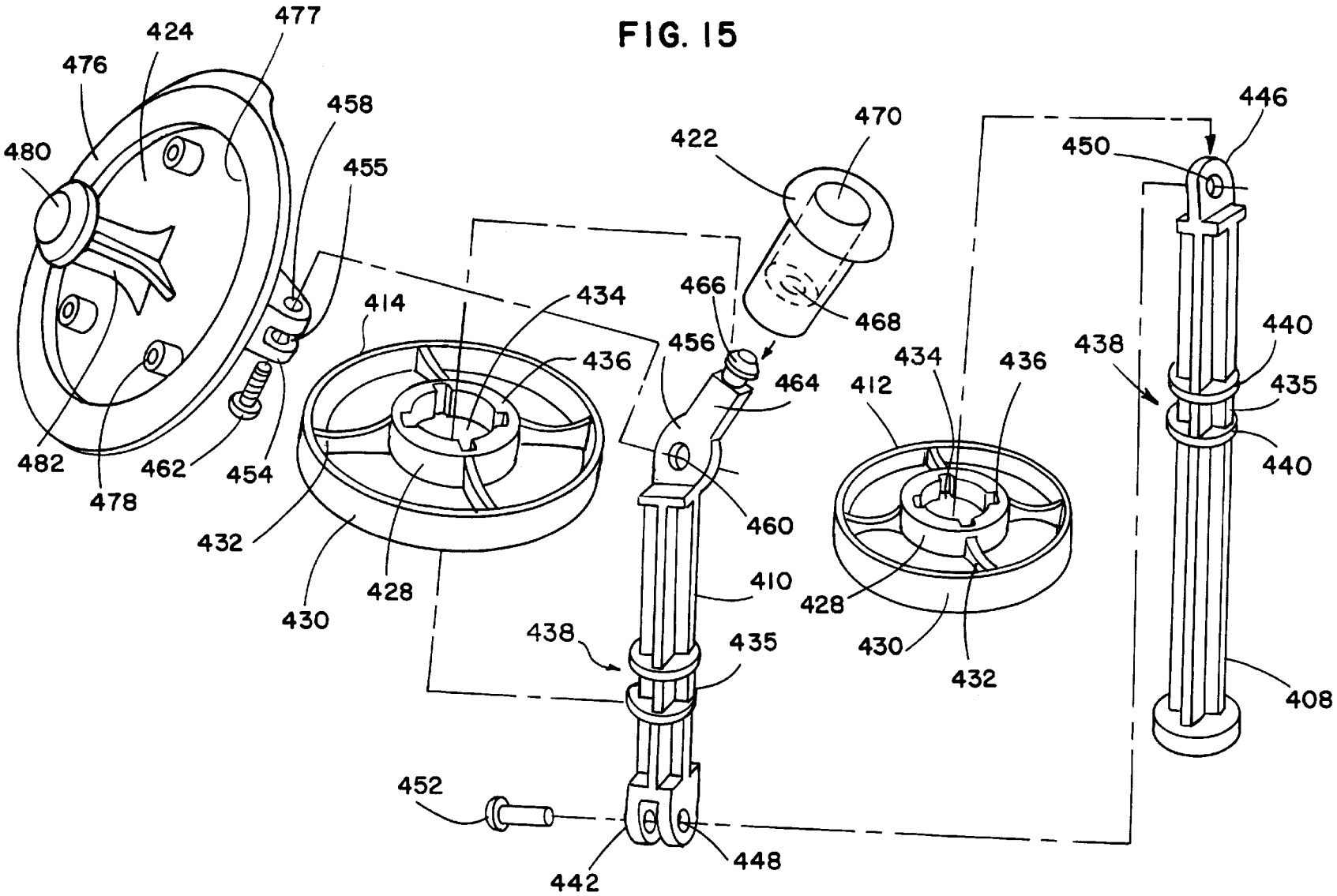
FIG. 15 is an exploded perspective view of the internal structural components of the leg of FIG. 14.

As can best be seen in FIG. 15, a clevis joint forms joint the knee 420. A U-shaped clevis piece 442 having a bore 448 extending through both sides thereof is formed at the lower end of the upper leg member 410, and a mating flat clevis 446 piece having a bore 450 formed therethrough is formed on the upper end of the lower leg member 408. The flat clevis piece is adapted to be inserted into the slot 444 formed in U-shaped clevis member 442 so that bore 450 aligns with bore 448, and pin 452 may be inserted therethrough to pivotally connect the lower leg member 408 to the upper leg member 410. Thus, the lower leg member may pivot freely relative to upper leg member 408.

The lateral hip joint 418 is formed in a similar manner. A U-shaped clevis is formed on the under side of hip disk 424 and has a bore 458 extending through both sides thereof. A flat clevis piece 456 is formed at the upper end of upper leg member 410, and has a bore 460 extending therethrough. The flat clevis piece is adapted to be inserted into the slot 455 formed in U-shaped clevis member 454 so that bore 460 aligns with bore 458, and pin 462 may be inserted therethrough to pivotally connect the upper leg member 410 to the hip disk member 424. Thus, the upper leg member 410 may pivot freely relative to the rotary hip joint 416 and the body 401.

The angle through which the upper leg member may pivot relative to the hip disk 424 is limited by a hip extension piece 464 that extends from the flat clevis piece 456. A mushroom connector 466 is formed at the end of extension piece 464. Hip spacer 422 comprises an end cap having a mounting bore 468 for receiving the mushroom connector 466. An outer support surface 470 is configured support the outer skin to provide an outward radial contour to the hip region of the toy figure.

Figure 16:
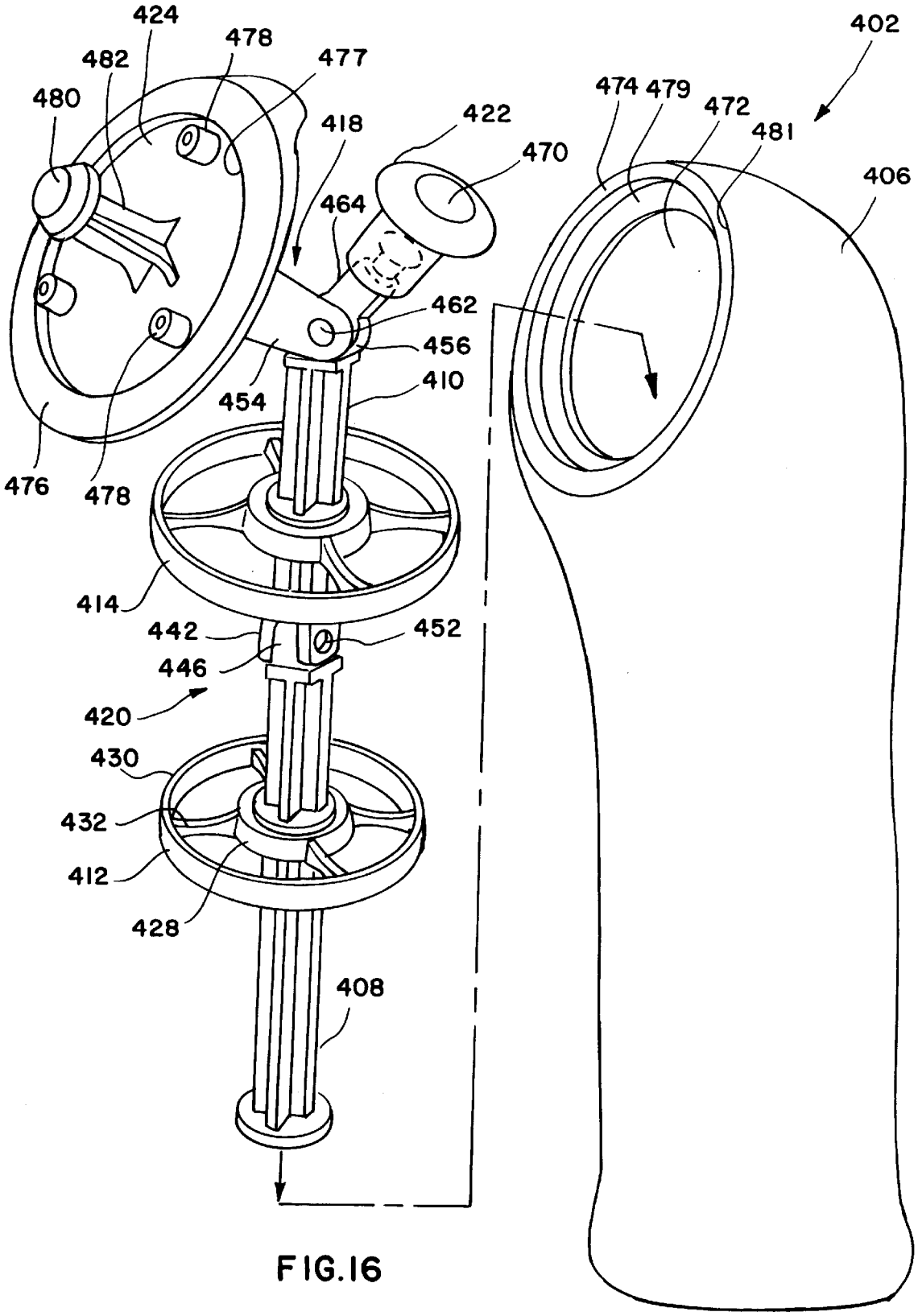
FIG. 16 is a perspective view of the assembled articulating structural components shown in FIG. 15, along with the soft outer skin into which the structural components are to be inserted.

As shown in FIG. 16, the assembled structural components of the articulating limb may be inserted into the molded outer skin 406 through an aperture 472 located at the radial hip joint. Aperture 472 is surrounded by an inwardly directed stepped annular ridge 474. The stepped profile of the ridge can be seen best in the cross sectional view of FIG. 14. The hip disk 424 includes an outer annular rim 476 which is thicker than the remainder of the disk surface, creating a depressed central region 477. When the structural components of the limb are inserted into the skin 406, the annular ridge may be stretched over the annular rim 476 of the hip disk, and once in place, the distal end 479 of the stepped annular ridge is seated within the depressed central region 477 of the disk and the thicker rim portion of the disk is seated under the proximal stepped portion 481 of the stepped ridge.

Figure 17:
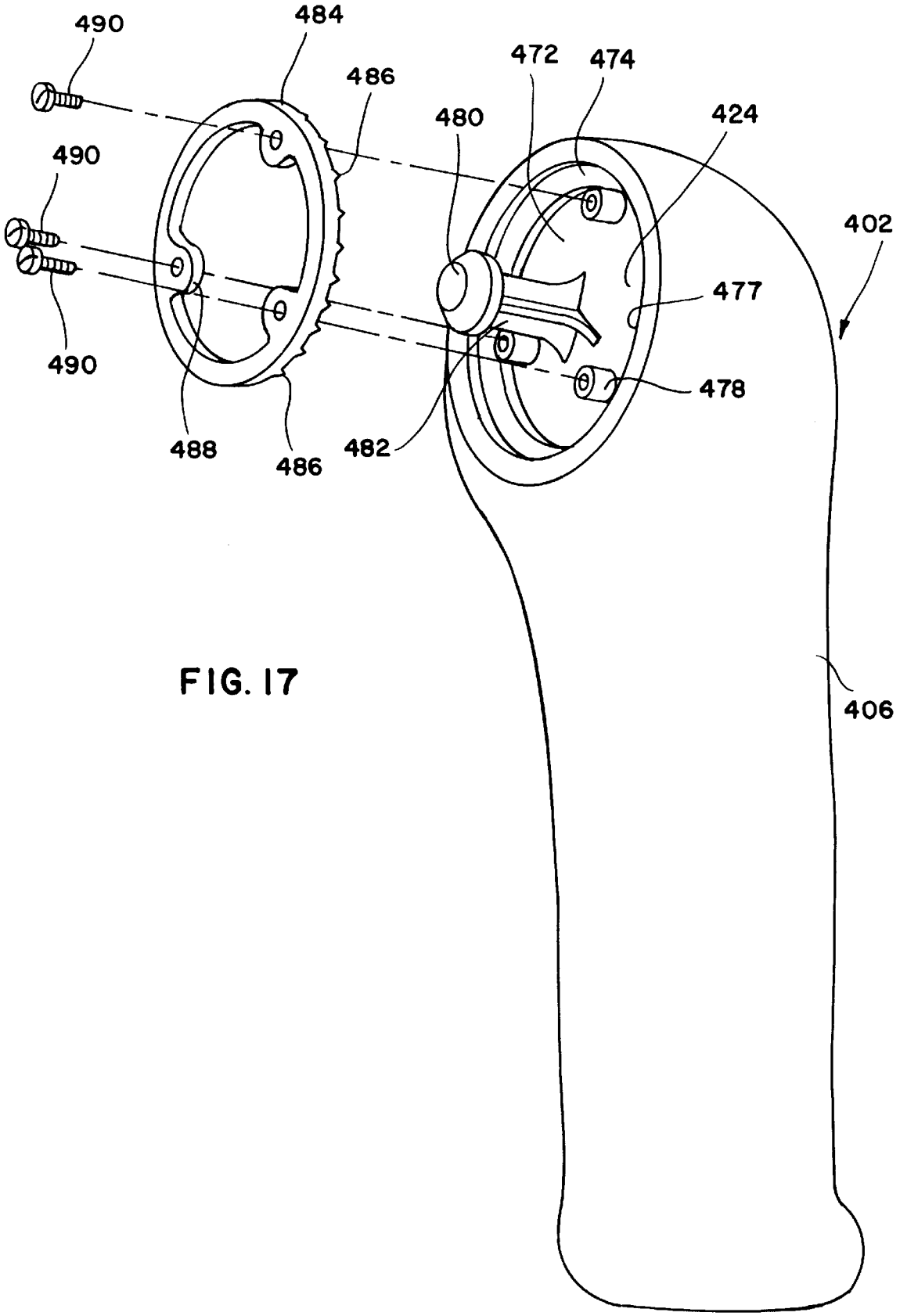
FIG. 17 is a perspective view of the assembled appendage of FIG. 16 including the hip joint components of the leg to attach to the body.

Turning to FIG. 17, a ring fastener 484 is provided to secure the molded skin to the hip disk 424. Threaded bosses 478 are formed on the recessed surface 477 of hip disk 424 and corresponding inwardly directed screw support flanges 488 are formed on the inner circumference of the ring fastener. Bores formed in the screw support flanges 488 align with the threaded bosses so that screws 490 may be driven through the flanges and into the bosses to attach the ring fastener to the hip disk. Spiny teeth 486 extend from the inner surface of the ring, and are adapted to sink into the molded skin comprising annular ridge 474 when the ring fastener is screwed onto the hip disk, thereby securing the molded skin to the hip disk.

Figure 18:
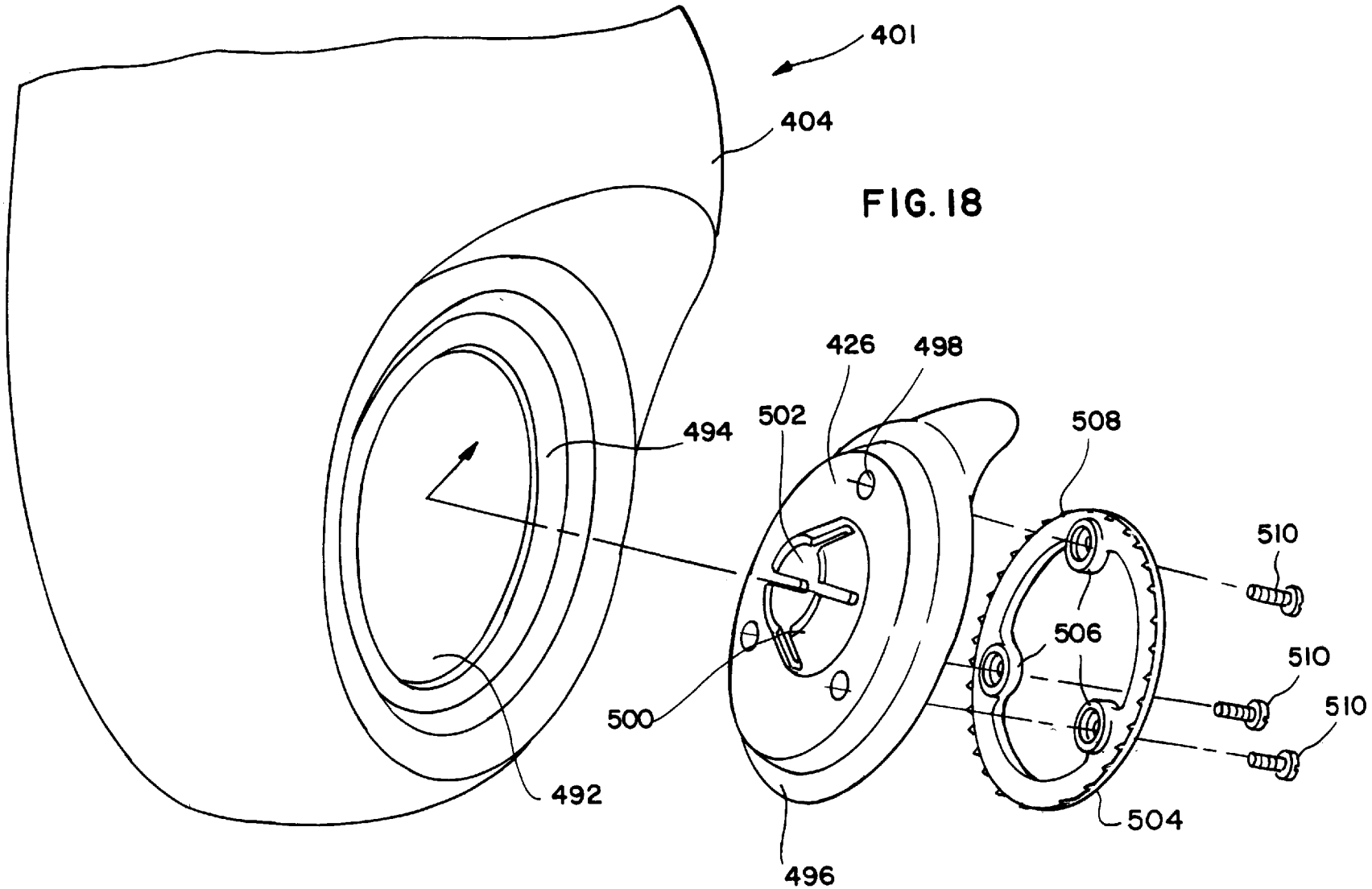
FIG. 18 is an exploded perspective view of the attachment area and hip joint components of the body where the leg is to be attached.

Turning to FIG. 18, the body side of the rotary hip joint assembly is shown. The body skin 404 includes an aperture 492 similar to the aperture 472 formed in the molded outer skin of the leg assembly. A stepped annular ridge 494 encircles the aperture and is adapted to receive the annular rim 496 formed around the outer edge of the receiving disk 426. Annular rim 496 creates a recessed central region 497 of receiving disk 426. When the receiving disk is inserted within the body skin 404, the annular ridge 494 may be stretched over the annular rim 496 of the receiving disk. Once in place, the distal step 499 f the stepped annular ridge is seated within the recessed central region 497 of the disk, and the thicker rim portion of the disk is seated against the proximal step 501 of the stepped ridge (see the cross sectional view of FIG. 14).

A ring fastener 504 is provided to secure the molded body skin to the receiving disk 426. Threaded bosses 498 are formed on the recessed surface of receiving disk 426 and corresponding inwardly directed screw support flanges 506 are formed on the inner circumference of the ring fastener. Screws 510 may be driven through the flanges and into the bosses to attach the ring fastener 504 to the receiving disk. Spiny teeth 508 extend from the inner surface of the ring and are adapted to sink into molded body skin 404 comprising annular ridge 494 when the ring fastener is screwed onto the receiving disk, thereby securing the molded skin to the hip disk.

Figure 19:
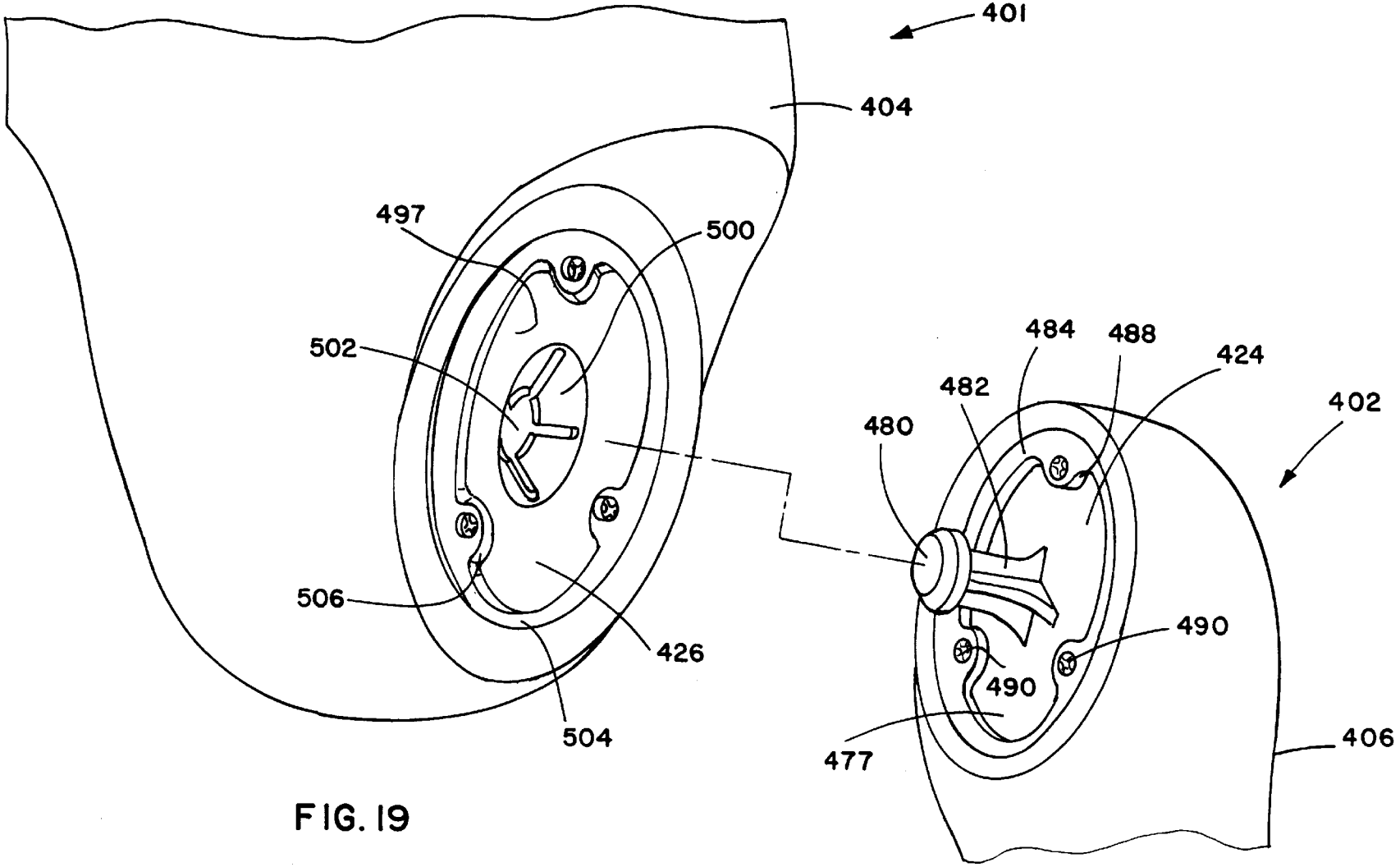
FIG. 19 is a perspective view of the appendage and the portion of the body of the toy figure embodiment of FIG. 14, as the leg is being attached.

The receiving disc 426 includes a central aperture 502 surrounded by inwardly directed flanged stays 500. As is indicated in FIG. 19, the aperture 502 is adapted to receive the mushroom connector 480 that is raised above the surface of the hip disk 424 by the spacer element 482. The inwardly projecting stays 500 flex outwardly as the mushroom connected is inserted into the central aperture 502, then once the mushroom connector passes the inwardly projecting stays, the stays collapse behind the connector, securing the limb to the body (see FIG. 14). The spacer 482 is smaller than the aperture 502 formed between the stays 500 so that the spacer is free to rotate therein while hip disk remains securely attached to the receiving disk, thereby allowing the limb to rotate relative to the body.

While the toy figures of the present invention have been described with respect to articulating leg limbs, it will be appreciated that the articulating structural members may be adapted to provide articulating arms or other limbs. For example, a toy animal may be provided with an articulating neck or tail comprising two or more substantial rigid structural member connected end to end by pivot joints, ball joints or the like. Likewise, the head of a toy figure or head/neck combination can be articulated, for example, with a pivot joint/mushroom joint combination to provide a head that can nod and rotate relative to the torso.

Applicants' foregoing description of the present invention is illustrative. Other modifications and variations will be apparent to those of ordinary skill in the art in light of applicants' specification, and such modifications and variations are within the scope of their invention defined by the following claims.

What is claimed is:

1. An toy figure comprising:

a body and limbs enclosed by a soft resiliently deformable skin; and an articulating support structure disposed within at least one of said limbs including first and second limb members and a first half of a rotary connector for rotatably joining the at least one support to the body, said support structure defining first and second pivoting joints, and including at least one spacer engaging said skin to support the skin away from the articulating limb structure.

2. The toy figure of claim 1 wherein the skin enclosing said limb includes an aperture located at a position where said first half of said rotary connector joins said limb to said body, the assembled articulating support structure being insertable through said aperture into said skin.

3. The toy figure of claim 2 further comprising an annular ridge surrounding said aperture.

4. The toy figure of claim 3 wherein said rotary connector comprises a rigid disk and a separate fastener ring configured to be joined to said disk with said annular ridge held firmly in place between said ring and said disk.

5. The toy figure of claim 4 wherein said fastener ring includes spiny teeth for gripping said annular ridge.

6. The toy figure of claim 5 further comprising a second half of a rotary connector mounted within said body and adapted to mate with the first half of the rotary connector associated with said articulating support structure.

7. The toy figure of claim 6 wherein the skin enclosing said body includes a second aperture located at a position where said first half of said rotary connector joins said limb to said body, the second half of the rotary connector being insertable through said second aperture into said body.

8. The toy figure of claim 7 further comprising a second annular ridge surrounding said second aperture.

9. The toy figure of claim 8 wherein said second half of said rotary connector comprises a second rigid disk and a second fastener ring configured to be joined to said second disk with said second annular ridge held firmly in place between the second fastener ring and the second disk.

10. The toy figure of claim 9 wherein the second fastener ring includes spiny teeth for gripping said second annular ridge.

11. The toy figure of claim 10 wherein said first half of said rotary connector includes a mushroom connector supported by a spacer above said disk, and the second half of said rotary connector defines an aperture for receiving said mushroom connector, said mushroom connector receiving aperture being lined with a plurality of inwardly directed stays.

12. The toy figure of claim 1 wherein at least one of said first and second joints comprises a clevis joint.

13. The toy figure of claim 1 wherein said at least one spacer comprises a radial spacer having a central hub and an outer rim supported by a plurality of spokes, said hub being configured to be carried by one of said first and second limb members.

14. The toy figure of claim 1 wherein said at least one spacer comprises a linear projection extending from one of said joints.

15. The toy figure of claim 1 wherein said resiliently deformable skin comprises about 40% by weight polyvinylchloride and about 55% by weight di($C_7$–$C_{12}$) alkylphthalate, wherein the alkyl moieties are one of linear or branched and.

16. The toy figure of claim 15 wherein the skin comprises about 40% by weight polyvinylcloride and about 55% by weight diisononylphthalate.

17. The toy figure of claim 1 wherein the body and limb are stuffed with a resilient fill material.

18. The toy figure of claim 17 wherein said resilient fill material comprises polyester fiber.

19. A rotary for joining an appendage to a body of a toy figure, the body and the appendage each having a soft resiliently deformable skin, and the appendage including an articulating support structure, the rotary joint comprising:

a first disk mountable within said body;

a first fastener ring removably attached to said first disk, said first fastener ring engaging the skin formed over said body and securing said skin between said first disk and said first fastener ring;

a second disk mountable within said appendage;

a second fastener ring removably attached to said second disk, said second fastener ring engaging the skin formed over said appendage and securing said skin between said second disk and said second fastener ring;

one of said first and second disks having a connecting member extending from a surface thereof, and the other of said first and second disks forming a connector receiving aperture in a surface thereof, said connector member and connector receiving aperture being configured such that said connector member may be inserted into said connector receiving aperture and rotatably retained therein.

20. The rotary joint of claim 19 wherein said connecting member comprises a mushroom shaped connector cap mounted on a spacer extending from the surface of the one of said first and second disks, and said connecting member receiving aperture is lined with a plurality of inwardly directed flanged stays configured to engage an under side of said mushroom shaped connector cap when said connecting member is inserted therethrough.

21. The rotary joint of claim 19 wherein at least one of said first and second fastener rings includes spiny teeth for gripping the respective first or second annular ridge.

22. The rotary joint of claim 19 further comprising threaded bosses formed on said first and second disks, and said first and second fastener rings being formed with screw support flanges such that said first and second fastener rings may be fastened to said disks by screws driven through said screw support flanges and into said threaded bosses.

23. The rotary joint of claim 19 wherein said skin covering said body defines an aperture surrounded by a stepped annular ridge, said first fastener ring being configured to engage said ridge.

24. The rotary joint of claim 19 wherein said skin covering said appendage defines and aperture surrounded by a stepped annular ridge, said second fastener ring being configured to engage said ridge.

* * * * *